US007989722B2

(12) United States Patent
McCurdy et al.

(10) Patent No.: US 7,989,722 B2
(45) Date of Patent: Aug. 2, 2011

(54) ILLUMINATED SWITCH DEVICE

(75) Inventors: Anthony McCurdy, Miyagi-ken (JP); Takayoshi Hoshi, Miyagi-ken (JP); Toshio Imai, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 360 days.

(21) Appl. No.: 12/246,049

(22) Filed: Oct. 6, 2008

(65) Prior Publication Data

US 2009/0114515 A1 May 7, 2009

(30) Foreign Application Priority Data

Nov. 2, 2007 (JP) ..... 2007-286020

(51) Int. Cl.
*H01H 9/00* (2006.01)

(52) U.S. Cl. ..... 200/314

(58) Field of Classification Search ..... 200/310–314; 362/24, 95

See application file for complete search history.

(56) References Cited

U.S. PATENT DOCUMENTS

| | | | | |
|---|---|---|---|---|
| 3,515,835 | A | 6/1970 | Debras | |
| 5,252,798 | A * | 10/1993 | Kamada | 200/314 |
| 7,164,092 | B2 * | 1/2007 | Kawano | 200/310 |
| 7,619,174 | B2 * | 11/2009 | Uenomachi et al. | 200/310 |

FOREIGN PATENT DOCUMENTS

| | | | |
|---|---|---|---|
| DE | 44 14 981 | A1 | 11/1995 |
| EP | 1 758 138 | A2 | 2/2007 |
| JP | 2006-252874 | | 9/2006 |

OTHER PUBLICATIONS

European Search Report issued in corresponding European Patent Application No. 08 01 8396; mailed May 7, 2010.

* cited by examiner

*Primary Examiner* — Renee S Luebke
*Assistant Examiner* — Lisa Klaus
(74) *Attorney, Agent, or Firm* — Brinks Hofer Gilson & Lione

(57) ABSTRACT

Disclosed is an illuminated switch device capable of effectively preventing light leakage between different light sources, thereby obtaining a good lighting quality, while reducing the overall size of the switch device. The illuminated switch device includes: a casing that has an open upper end and a partition wall provided therein and is formed on a bottom plate member having light sources and a push switch mounted thereon; and an operating body that has a light-shielding wall provided on the rear surface of an upper plate, is arranged so as to close the open end, and can be pressed. First and second illuminated regions to which light components are emitted from first and second light sources are provided on the upper plate. A protruding portion is formed at a leading end portion of a light-shielding wall, and a concave groove is provided at a leading end portion of a partition wall. The leading end portions are opposite to each other such that they can approach or separate from each other. At least a part of the protruding portion is arranged in the concave groove, and a gap is formed between the leading ends of the protruding portion and the concave portion.

4 Claims, 4 Drawing Sheets

ILLUMINATED SWITCH DEVICE

CLAIM OF PRIORITY

This application claims benefit of the Japanese Patent Application No. 2007-286020 filed on Nov. 2, 2007, the entire contents which are hereby incorporated by reference.

BACKGROUND

1. Technical Field

The present invention relates to an illuminated switch device in which a plurality of light sources are provided in a casing so as to correspond to a plurality of illuminated regions that are provided on an upper plate of an operating body, and more particularly, to a technique for preventing light leakage between different light sources.

2. Related Art

The structure of this type of illuminated switch device according to the related art will be described with reference to FIG. 7. In a casing 1, a first light source 3 and a second light source 4 are provided on a bottom plate member 2 so as to be parallel to each other, and a partition wall 5 is formed between the light sources 3 and 4. In addition, a switch element (not shown) is mounted on the bottom plate member 2, and external connection terminals (not shown) that are electrically connected to the switch element and the light sources 3 and 4 are provided at predetermined positions of the bottom plate member 2. An open end 1*a* is provided at the top of the casing 1. An operating body 6 is arranged so as to close the open end 1*a*, is supported by the casing 1 so as to be movable in the vertical direction, and is pressed. First and second illuminated regions 7 and 8 made of, for example, a light transmissive resin are provided on the upper plate 6*a* of the operating body 6. The first illuminated region 7 is opposite to the first light source 3, and the second illuminated region 8 is opposite to the second light source 4. A light-shielding wall 9 protrudes downward from the rear surface of the upper plate 6*a* of the operating body 6 to pass through the open end 1*a*. The light-shielding wall 9 is provided between a space below the first illuminated region 7 and a space below the second illuminated region 8. When the operating body 6 is moved in the vertical direction, the light-shielding wall 9 slides on the partition wall 5. A driving portion (not shown) that presses the switch element is attached to the operating body 6. When the operating body 6 is pressed, the driving portion is moved down together with the operating body to press the switch element. In this way, a contact switching operation of the switch element is performed. When pressing force against the operating body 6 is removed, the operating body 6 automatically returns to its initial position by elastic force of a return spring (not shown) (see JP-A-2006-252874).

In the illuminated switch device having the above-mentioned structure, when the first light source 3 is turned on, light is emitted to the first illuminated region 7 that is provided immediately above the light source. Therefore, it is possible to illuminate the first illuminated region 7. In this case, some of the light components emitted from the first light source 3 travel to the second illuminated region 8. However, since the partition wall 5 and the light-shielding wall 9 are formed of a light-shielding material, it is possible to prevent light emitted from the first light source 3 from leaking to the second illuminated region 8. Similarly, when the second light source 4 is turned on, light is emitted to the second illuminated region 8 that is provided immediately above the light source. Therefore, it is possible to illuminate the second illuminated region 8. However, light emitted from the second light source 4 to the first illuminated region 7 is shielded by the partition wall 5 and the light-shielding wall 9.

However, in the illuminated switch device according to the related art shown in FIG. 7, a clearance C for controlling friction between the light-shielding wall 9 and the partition wall 5 should be ensured. Therefore, there is a problem in that some of the light components emitted from the second light source 4 reach the first illuminated region 7 through the clearance C. That is, some of the light components emitted from the second light source 4 reach the first illuminated region 7 through the clearance C. When the first light source 3 is turned off, light should not be incident on the first illuminated region 7, but some of the light components emitted from the second light source 4 reach the first illuminated region 7 through the clearance C. In addition, when the first light source 3 is turned on, irregular brightness occurs in the first illuminated region 7 due to interference between light components emitted from the first and second light sources 3 and 4. As a result, it is difficult to obtain a good lighting quality.

In the structure shown in FIG. 7, in order to prevent light leakage between the light sources 3 and 4, the light-shielding wall 9 may be inserted between two partition walls formed on the bottom plate member 2, or the partition wall 5 may be provided between two light-shielding walls formed on the upper plate 6*a*. However, in this case, the diameter of the casing 1 or the operating body 6 increases, and the overall size of the switch device increases. Therefore, this structure is not preferable.

SUMMARY

According to an aspect of the invention, an illuminated switch device includes: a casing having an open end; an operating body that has first and second illuminated regions provided on an upper plate, is arranged so as to close the open end of the casing, and can be pressed; a light-shielding wall that protrudes from the rear surface of the upper plate of the operating body between the first illuminated region and the second illuminated region; a driving portion that can be pressed together with the operating body; a switch element that is driven by the driving portion; a partition wall that protrudes from the inner bottom of the casing toward the open end to partition the inside of the casing into a first space and a second space; a first light source that is provided on the inner bottom in the first space and emits light to the first illuminated region; and a second light source that is provided on the inner bottom in the second space and emits light to the second illuminated region. The light-shielding wall and the partition wall are arranged such that their leading end portions can approach or separate from each other. A protruding portion is formed in one of the two leading end portions, and a concave groove is formed in the other leading end portion. At least a part of the protruding portion is arranged in the concave groove.

In the illuminated switch device having the above-mentioned structure, since the leading end portion of the light-shielding wall, which is formed on the rear surface of the upper plate of the operating body, is opposite to the leading end portion of the partition wall, which is formed on the inner bottom of the casing, so as to approach or separate from the leading end portion of the partition wall, a gap whose length is variable according to the pressing operation of the operating body is formed between the two leading end portions. However, since the gap between the protruding portion and the concave groove is greatly curved, light emitted from the first light source is less likely to reach the second illuminated region through the gap, and light emitted from the second light source is less likely to reach the first illuminated region through the gap. Therefore, it is possible to prevent light leakage between two light sources using one light-shielding wall and one partition wall having leading end portions opposite to each other. As a result, it is possible to obtain a good lighting quality while preventing an increase in the diameter of an operating body or a casing.

DESCRIPTION OF EXEMPLARY EMBODIMENTS

Figure 1:
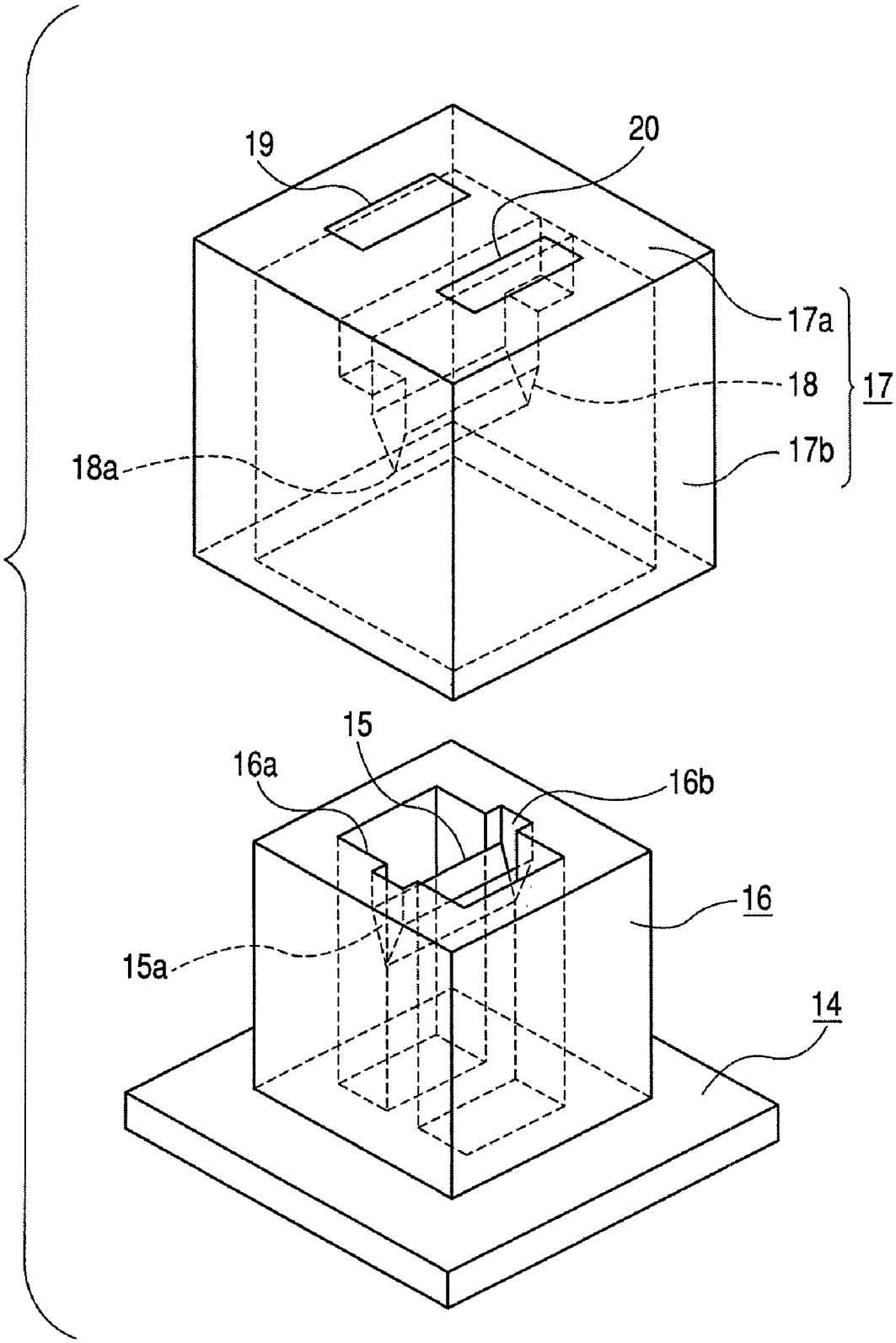
FIG. 1 is an exploded perspective view illustrating an illuminated switch device according to a first embodiment of the invention.
Figure 2:
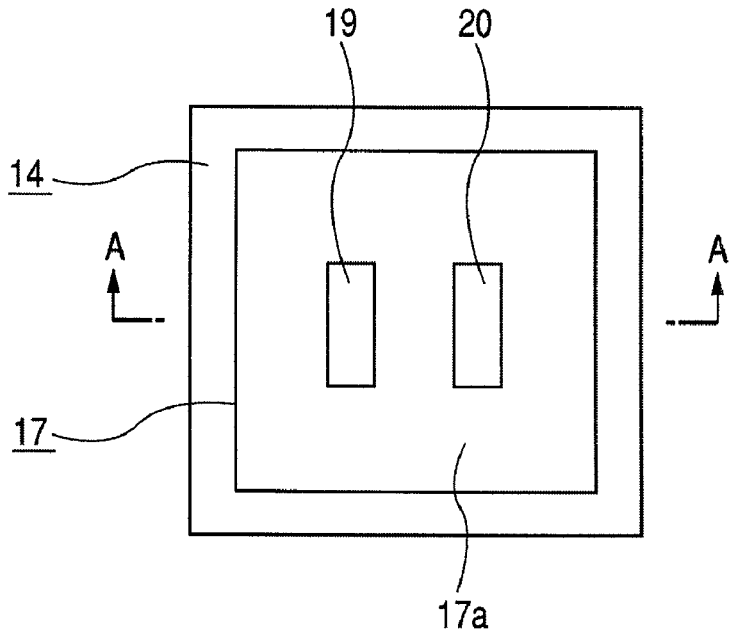
FIG. 2 is a plan view illustrating the switch device shown in FIG. 1.
Figure 3:
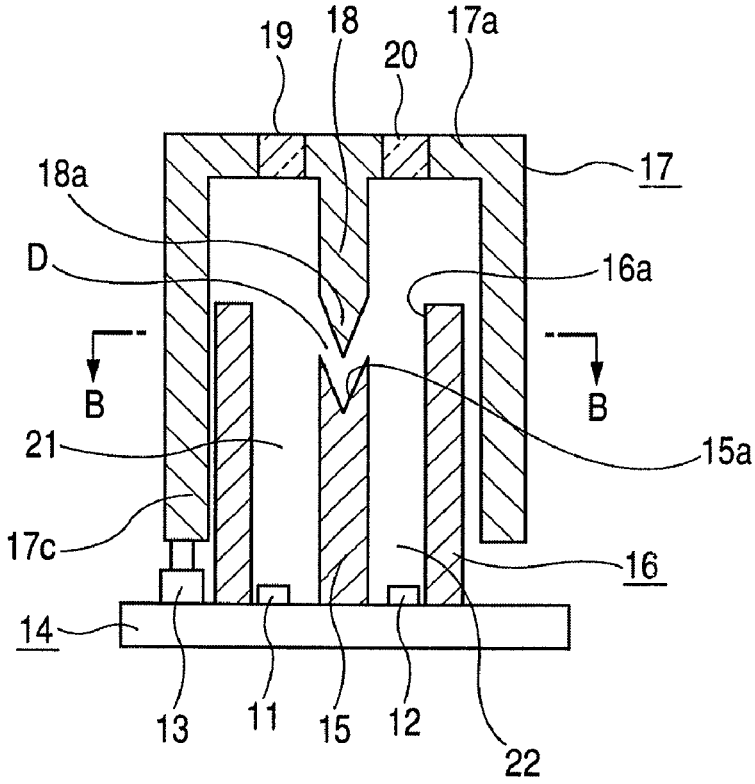
FIG. 3 is a cross-sectional view taken along the line III-III of FIG. 2.
Figure 4:
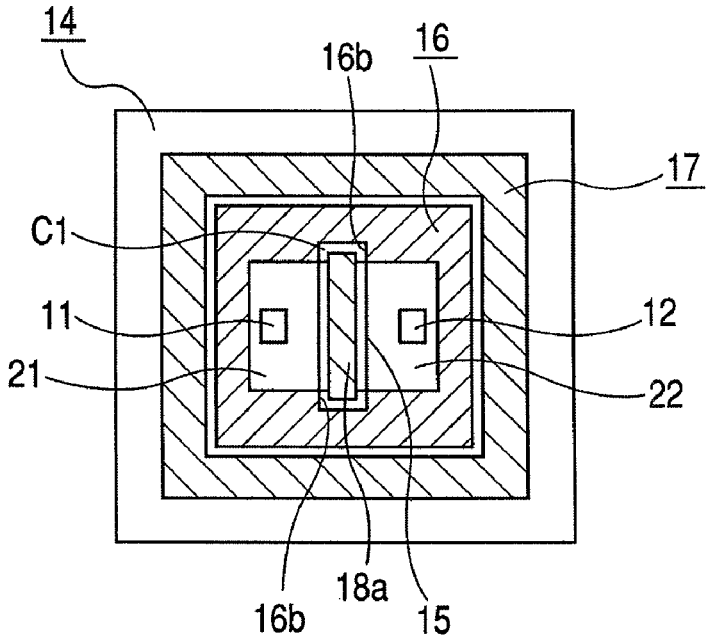
FIG. 4 is a cross-sectional view taken along the line IV-IV of FIG. 3.

Hereinafter, exemplary embodiments of the invention will be described with reference to the accompanying drawings. FIG. 1 is an exploded perspective view illustrating an illuminated switch device according to a first embodiment of the invention. FIG. 2 is a plan view illustrating the switch device. FIG. 3 is a cross-sectional view taken along the line III-III of FIG. 2. FIG. 4 is a cross-sectional view taken along the line IV-IV of FIG. 3.

The illuminated switch device shown in the drawings includes: a bottom plate member (substrate) 14 having a first light source 11, a second light source 12, and a push switch 13 mounted thereon; a casing 16 that is provided on the bottom plate member 14, has an open upper end 16*a*, and includes a partition wall 15 provided therein; and an operating body 17 that has a light-shielding wall 18 provided on the rear surface of an upper plate 17*a*, is arranged so as to close the open end 16*a*, and can be pressed. A first illuminated region 19 and a second illuminated region 20 are provided on the upper plate 17*a* of the operating body 17.

The first light source 11 and the second light source 12 are LEDs that are provided in parallel to each other on the bottom plate member 14, and a partition wall 15 provided between the two light sources 11 and 12 divides the inside of the casing 16 into a first space 21 and a second space 22. The partition wall 15 protrudes from the inner bottom of the casing 16 to the open end 16*a*. The height of a leading end portion (upper end portion) of the partition wall 15 is smaller than that of the open end 16*a*, and a concave groove 15*a* having a V shape in a cross-sectional view is formed at the leading end portion of the partition wall 15. A pair of cutout portions 16*b* are formed at the upper end portion of the casing 16 so as to be connected to the open end 16*a*. The width of the open end 16*a* substantially at the center thereof is increased by the cutout portions 16*b*, and both ends of the concave groove 15*a* in the longitudinal direction extend into the cutout portions 16*b* to form the bottoms of the cutout portions 16*b*. That is, in the open end 16*a*, substantially central portions having a large width are opposite to the concave grooves 15*a* of the casing 16. In addition, one region of the open end 16*a* is opposite to the first space 21 and the other region is opposite to the second space 22, with the wide region interposed therebetween. Although not shown in the drawings, external connection terminals are provided at predetermined positions of the bottom plate member 14 so as to be electrically connected to the light sources 11 and 12 and the push switch 13. The casing 16 including the partition wall 15 is formed of a light-shielding resin.

The operating body 17 includes the upper plate 17*a*, a square cylinder 17*b* that is fitted to the casing 16, a light-shielding wall 18 that protrudes downward from the rear surface of the upper plate 17*a*, which are integrally formed with each other. A portion of the square cylinder 17*b* serves as a driving portion 17*c* that presses the push switch 13. The first and second illuminated regions 19 and 20 made of a light transmissive resin are provided in the upper plate 17*a*. Portions of the operating body 17 other than the illuminated regions 19 and 20 are formed of a light-shielding resin. In addition, the light-shielding wall 18 is formed on the rear surface of the upper plate 17*a* between the first illuminated region 19 and the second illuminated region 20. The first illuminated region 19 is positioned immediately above the first light source 11, and the second illuminated region 20 is positioned immediately above the second light source 12. The operating body 17 is supported by the casing 16 so as to be movable in the vertical direction. The light-shielding wall 18 passes through the substantially central portion of the open end 16*a* having a large width and is disposed immediately above the partition wall 15. The driving portion 17*c* is arranged immediately above the push switch 13. The light-shielding wall 18 has a V-shaped protruding portion 18*a* at a leading end portion (lower end portion) thereof, and the protruding portion 18*a* can be inserted into or separated from the concave groove 15*a*. However, as shown in FIG. 3, when the operating body 17 is not pressed, the protruding portion 18*a* is slightly inserted into the concave groove 15*a*. When the operating body 17 is pressed, the protruding portion 18*a* is deeply inserted into the concave groove 15*a*. As shown in FIG. 4, both ends of the protruding portion 18*a* are arranged in a pair of cutout portions 16*b*.

In the illuminated switch device having the above-mentioned structure, when the operating body 17 is pressed, the driving portion 17*c* and the light-shielding wall 18 are moved down together with the operating body. Then, the driving portion 17*c* presses the push switch 13 to perform a contact switching operation, and the protruding portion 18*a* formed at the leading end of the light-shielding wall 18 is deeply inserted in the concave groove 15*a*. That is, a gap D that has a V shape in a cross-sectional view and is formed between the protruding portion 18*a* and the concave groove 15*a* is narrowed when the operating body 17 is pressed. When pressing force against the operating body 17 is removed, the operating body 17 automatically returns to its initial position by elastic force of a return spring (not shown).

In the illuminated switch device, for example, the first illuminated region 19 is for displaying characters, and the second illuminated region 20 is for an indicator. When the first light source 11 is turned on, light is emitted to the first illuminated region 19 immediately above the light source. Therefore, it is possible to illuminate the first illuminated region 19. Similarly, when the second light source 12 is turned on, light is emitted to the second illuminated region 20 immediately above the light source. Therefore, it is possible to illuminate the second illuminated region 20. When the first light source 11 is turned on and the second light source 12 is turned off, light emitted from the first light source 11 reaches the second illuminated region 20, and the second illuminated region 20 is dimly illuminated. However, according to this embodiment, the partition wall 15, the light-shielding wall 18, and the gap D having a V shape in a cross-sectional view can shield light emitted from the first light source 11. Therefore, it is possible to prevent light emitted from the first light source 11 from leaking to the second illuminated region 20. Similarly, the partition wall 15, the light-shielding wall 18, and the gap D can shield light emitted from the second light source 12. Therefore, it is possible to prevent light emitted from the second light source 12 from leaking to the first illuminated region 19.

As described above, in the illuminated switch device according to this embodiment, the leading end portion of the light-shielding wall 18 that protrudes from the rear surface of the upper plate 17*a* of the operating body 17 is opposite to the leading end portion of the partition wall 15 that is provided on the inner bottom of the casing 16 so as to be inserted into or separated from the leading end portion of the partition wall 15. The gap D having a length that is increased or decreased according to the pressing operation of the operating body 17 is formed between the two leading end portions. The gap D is formed between the protruding portion 18*a* and the concave groove 15*a* so as to be greatly curved, and light emitted from the first light source 11 or the second light source 12 is less likely to pass through the gap D. Therefore, light emitted from the first light source 11 hardly reaches the second illuminated region 20 through the gap D, and light emitted from the second light source 12 hardly reaches the first illuminated region 19 through the gap D. Thus, the illuminated switch device can effectively prevent the leakage of light between the first and second light sources 11 and 12 using the leading end portions of the light-shielding wall 18 and the partition wall 15 opposite to each other. As a result, it is possible to ensure a good lighting quality without increasing the sizes of the operating body 17 and the casing 16, that is, without increasing the overall size of a device.

In the illuminated switch device according to this embodiment, a pair of cutout portions 16*b* into which both ends of the protruding portion 18*a* are inserted are provided in the casing 16, and the cutout portions 16*b* increase the width of a portion of the open end 16*a* between the first and second spaces 21 and 22. In addition, both ends of the concave groove 15*a* in the longitudinal direction are arranged in the bottoms of the pair of cutout portions 16*b*. Therefore, a clearance C1 (see FIG. 4) between the inner wall surface of the casing 16 and the side surface of the light-shielding wall 18, which is required to control sliding resistance, is formed in the innermost part of the cutout portion 16*b* corresponding to the innermost part of the wide region of the open end 16*a*. This structure can prevent light emitted from the first light source 11 or the second light source 12 from leaking through the clearance C1. That is, in the illuminated switch device, the gap D below the light-shielding wall 18 can prevent light leakage, and the clearance C1 formed at the side of the light-shielding wall 18 can also prevent light leakage. Therefore, it is possible to reliably prevent the leakage of light between the first and second light sources 11 and 12.

In the first embodiment, the protruding portion 18*a* and the concave groove 15*a* have sharp V shapes in a cross-sectional view, but the invention is not limited thereto. For example, the protruding portion 18*a* and the concave groove 15*a* may have round V shapes in a cross-sectional view. However, it is preferable that the gap D between the protruding portion 18*a* and the concave groove 15*a* have a substantially V shape in order to effectively prevent light leakage.

Figure 5:
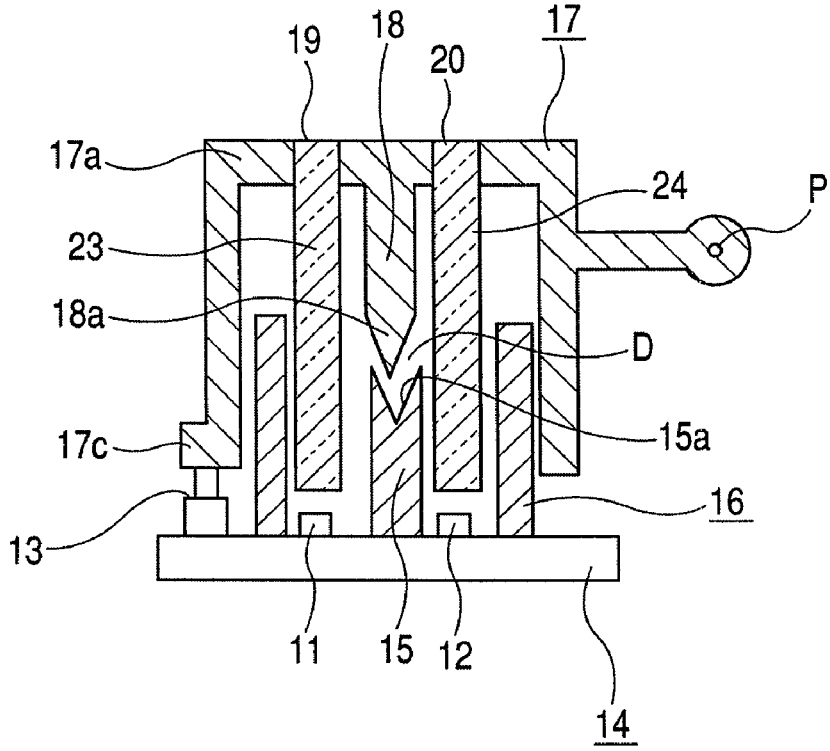
FIG. 5 is a cross-sectional view illustrating an illuminated switch device in a non-pressed state according to a second embodiment of the invention.
Figure 6:
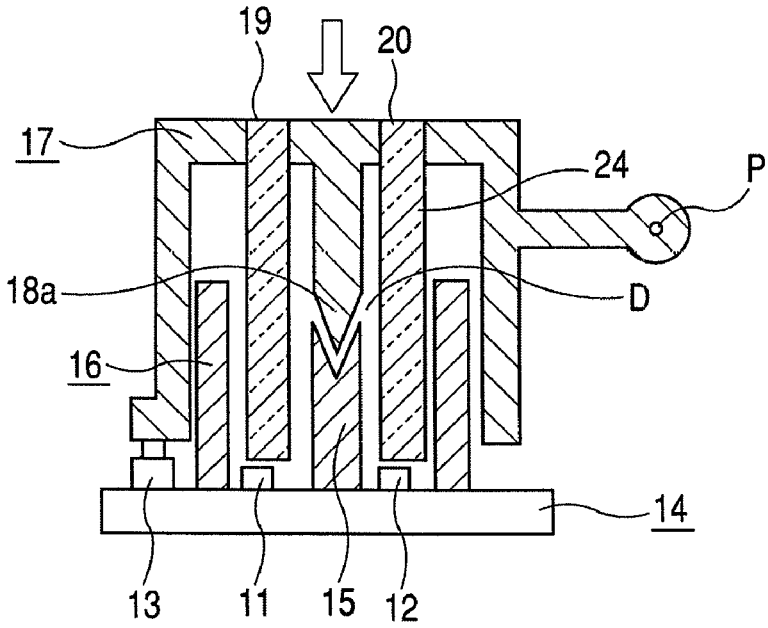
FIG. 6 is a cross-sectional view illustrating the switch device shown in FIG. 5 in a pressed state.
Figure 7:
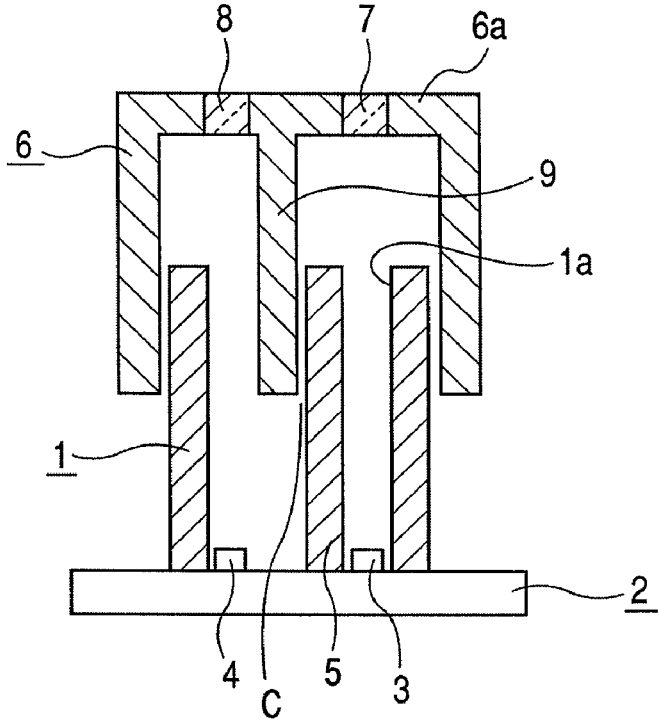
FIG. 7 PRIOR ART
FIG. 7 is a cross-sectional view illustrating an illuminated switch device according to the related art.

FIG. 5 is a cross-sectional view illustrating an illuminated switch device in a non-pressed state according to a second embodiment of the invention, and FIG. 6 is a cross-sectional view illustrating the switch device in a pressed state. In the second embodiment, the same components as those shown in FIGS. 1 to 4 are denoted by the same reference numerals, and a description thereof will be omitted.

The illuminated switch device shown in FIGS. 5 and 6 differs from that according to the first embodiment in that the operating body 17 is swingably supported by the casing 16 and light components emitted from the light sources 11 and 12 are emitted to the illuminated regions 19 and 20 through light guide bodies 23 and 24, respectively. In the illuminated switch device, the light guide bodies 23 and 24 extending from the illuminated regions 19 and 20 face the light sources 11 and 12, respectively. Therefore, the light guide bodies can effectively guide light emitted from the light sources 11 and 12 to the illuminated regions 19 and 20, respectively. In addition, as shown in FIG. 5, in the illuminated switch device, when the operating body 17 is not pressed, the light-shielding wall 18 is arranged at a position that deviates from an extension of the partition wall 15 (a position immediately above the partition wall). When the operating body 17 is pressed, the light-shielding wall 18 is positioned close to the extension of the partition wall 15. In this way, as shown in FIG. 6, when the operating body 17 is pressed, the protruding portion 18*a* can be inserted deep into the concave groove 15*a* to narrow the gap D between the protruding portion 18*a* and concave groove 15*a*. As a result, it is possible to prevent light leakage between the first and second light sources 11 and 12.

In the second embodiment, the pivot P of the operating body 17 is set at a position that is higher than the protruding portion 18*a*, and the light-shielding wall 18 deviates from the extension of the partition wall 15 so as to be further away from the pivot P than the extension. However, the invention is not limited thereto. The pivot P of the operating body 17 may be provided at a position that is lower than the protruding portion 18*a*. In this case, the light-shielding wall 18 may deviate from the extension of the partition wall 15 so as to be closer to the pivot P than the extension.

In the above-described embodiments, two illuminated regions 19 and 20 provided in the operating body 17 are individually illuminated by the light sources 11 and 12. However, the invention is not limited thereto. The number of light sources may increase, and illuminated regions corresponding to the number of light sources may be provided in the operating body. In this case, the invention may be applied to prevent light leakage among the light sources.

What is claimed is:

1. An illuminated switch device comprising:

a casing having an open end;

an operating body that has first and second illuminated regions provided on an upper plate, is arranged so as to close the open end of the casing, and can be pressed;

a light-shielding wall that protrudes from a rear surface of the upper plate of the operating body between the first illuminated region and the second illuminated region;

a driving portion that can be pressed together with the operating body;

a switch element that is driven by the driving portion;

a partition wall that protrudes from an inner bottom of the casing toward the open end to partition an inside of the casing into a first space and a second space;

a first light source that is provided on an inner bottom in the first space and emits light to the first illuminated region; and a second light source that is provided on the inner bottom in the second space and emits light to the second illuminated region, the light-shielding wall and the partition wall arranged such that leading end portions can approach or separate from each other, a protruding portion formed in one of the two leading end portions, and a concave groove is formed in the other leading end portion, at least a part of the protruding portion arranged in the concave groove, the protruding portion formed at the leading end portion of the light-shielding wall, and the concave groove formed at the leading end portion of the partition wall, and a pair of cutout portions into which both ends of the protruding portion are inserted formed in the casing, wherein, in the open end of the casing, the width of a region between the first and second spaces is increased by the cutout portions, and both ends of the concave groove in a longitudinal direction are arranged in the bottoms of the cutout portions.

2. The illuminated switch device according to claim 1, wherein both the protruding portion and the concave groove are substantially V-shaped in cross-sections.

3. An illuminated switch device comprising:

a casing having an open end;

an operating body that has first and second illuminated regions provided on an upper plate, is arranged so as to close the open end of the casing, and can be pressed;

a light-shielding wall that protrudes from a rear surface of the upper plate of the operating body between the first illuminated region and the second illuminated region;

a driving portion that can be pressed together with the operating body;

a switch element that is driven by the driving portion;

a partition wall that protrudes from an inner bottom of the casing toward the open end to partition an inside of the casing into a first space and a second space;

a first light source that is provided on an inner bottom in a first space and emits light to the first illuminated region; and a second light source that is provided on the inner bottom in the second space and emits light to the second illuminated region, the light-shielding wall and the partition wall arranged such that leading end portions can approach or separate from each other, a protruding portion formed in one of the two leading end portions, and a concave groove is formed in the other leading end portion, at least a part of the protruding portion arranged in the concave groove, the protruding portion formed at the leading end portion of the light-shielding wall, and the concave groove formed at the leading end portion of the partition wall, and the operating body swingably supported by the casing, wherein, when the operating body is not pressed, the light-shielding wall is arranged so as to deviate from an extension of the partition wall, and when the operating body is pressed, the light-shielding wall is positioned close to the extension of the partition wall.

4. The illuminated switch device according to claim 3, wherein both the protruding portion and the concave groove are substantially V-shaped in cross-sections.

* * * * *